US007376978B2

(12) United States Patent
Godshaw

(10) Patent No.: US 7,376,978 B2
(45) **Date of Patent: *May 27, 2008**

(54) KNEE PAD CONSTRUCTION

(75) Inventor: Donald E. Godshaw, Evanston, IL (US)

(73) Assignee: Travel Caddy, Inc., Elk Grove Village, IL (US)

( * ) Notice: Subject to any disclaimer, the term of this patent is extended or adjusted under 35 U.S.C. 154(b) by 201 days.

This patent is subject to a terminal disclaimer.

(21) Appl. No.: 10/943,347

(22) Filed: Sep. 17, 2004

(65) Prior Publication Data

US 2006/0041986 A1 Mar. 2, 2006

Related U.S. Application Data

(63) Continuation-in-part of application No. 10/926,240, filed on Aug. 25, 2004, now Pat. No. 7,181,770.

(51) Int. Cl.
*A41D 13/00* (2006.01)

(52) U.S. Cl. ..... 2/24

(58) Field of Classification Search ..... 2/16, 2/22, 24, 455, 908, 242, 911; 128/881, 882; 602/6, 26, 62

See application file for complete search history.

(56) References Cited

U.S. PATENT DOCUMENTS

| | | | | |
|---|---|---|---|---|
| 830,661 | A | 9/1906 | Graham | |
| 967,004 | A | 8/1910 | Ehikian | |
| 1,055,040 | A | 3/1913 | Herron | |
| 1,090,446 | A | 3/1914 | Boynton | |
| 1,486,308 | A * | 3/1924 | Shook | 2/24 |
| 2,195,817 | A | 4/1940 | Johnson | |
| 2,418,197 | A | 4/1947 | Sherer | |
| 2,759,189 | A * | 8/1956 | Cole | 2/24 |
| 3,465,365 | A | 9/1969 | Jones et al. | |
| 3,587,672 | A | 6/1971 | Evans | |
| 3,728,736 | A | 4/1973 | Pugh | |
| 3,735,419 | A | 5/1973 | Byrd | |
| 3,772,704 | A | 11/1973 | Carbonneau | |
| 4,116,236 | A | 9/1978 | Albert | |
| 4,287,885 | A | 9/1981 | Applegate | |
| 4,507,804 | A | 4/1985 | Consigny | |
| 4,681,012 | A | 7/1987 | Stelma | |
| 4,692,946 | A | 9/1987 | Jurga | |
| D297,178 | S | 8/1988 | Jurga | |
| 4,893,355 | A | 1/1990 | Ritter | |
| 5,031,240 | A | 7/1991 | Nierhaus | |
| 5,301,370 | A | 4/1994 | Henson | |
| 5,334,135 | A | 8/1994 | Grim et al. | |
| 5,347,657 | A | 9/1994 | Unsell | |

(Continued)

FOREIGN PATENT DOCUMENTS

DE 43 26 433 C1 4/1995

OTHER PUBLICATIONS

The Home Depot; Ad # 63693/63698; May-Jun. 2004.

*Primary Examiner*—Tejash Patel
(74) *Attorney, Agent, or Firm*—Banner & Witcoff, Ltd.

(57) ABSTRACT

A knee pad construction includes a shaped cushion element with a concave interior with a recess having a flowable gel insert therein. The recess and insert are shaped to accommodate the left knee or the right knee of an individual.

6 Claims, 10 Drawing Sheets

U.S. PATENT DOCUMENTS

| | | | | |
|---|---|---|---|---|
| 5,500,955 | A | 3/1996 | Gongea | |
| 5,524,292 | A | 6/1996 | Hargens | |
| 5,537,689 | A | 7/1996 | Dancyger | |
| 5,711,029 | A * | 1/1998 | Visco et al. | 2/24 |
| 5,760,868 | A | 6/1998 | Jannard et al. | |
| 5,794,261 | A | 8/1998 | Hefling | |
| 6,128,779 | A | 10/2000 | Goldsmith et al. | |
| 6,223,350 | B1 | 5/2001 | McFarlane | |
| D473,977 | S | 4/2003 | Lesosky | |
| 6,584,616 | B2 * | 7/2003 | Godshaw et al. | 2/24 |
| 6,820,279 | B2 * | 11/2004 | Lesosky | 2/24 |
| 2004/0111780 | A1 | 6/2004 | Lesosky | |

* cited by examiner

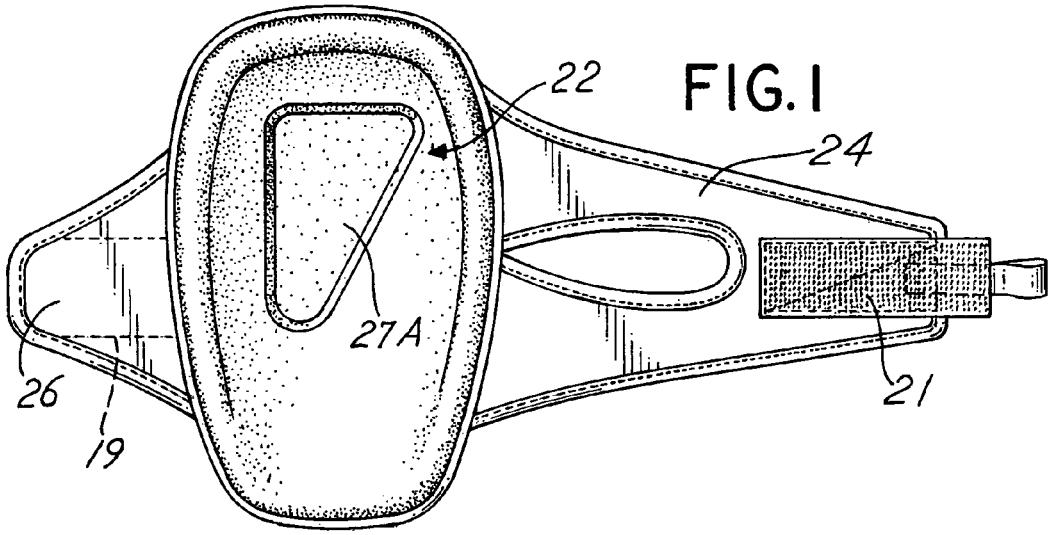
FIG. 1
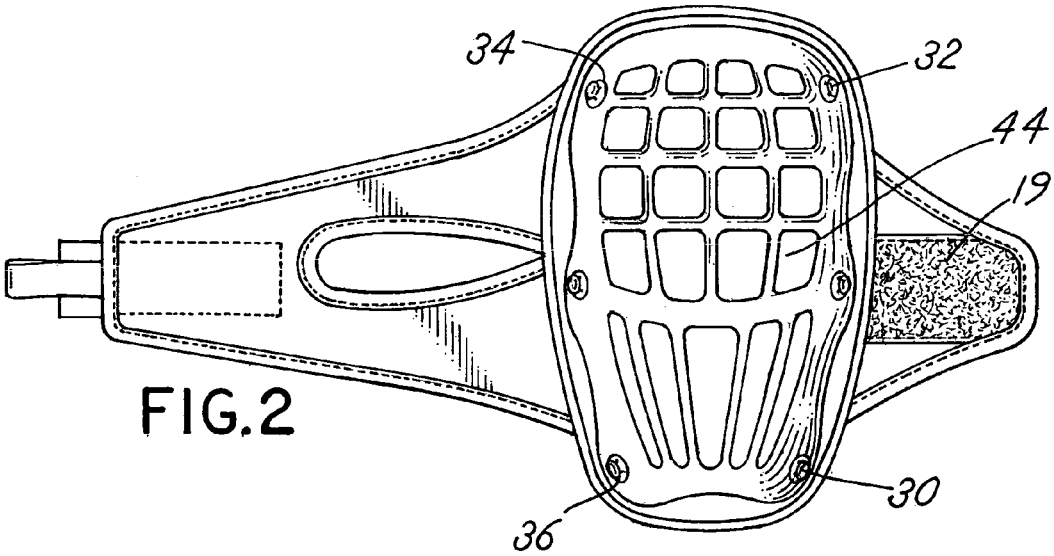
FIG. 2
FIG. 3
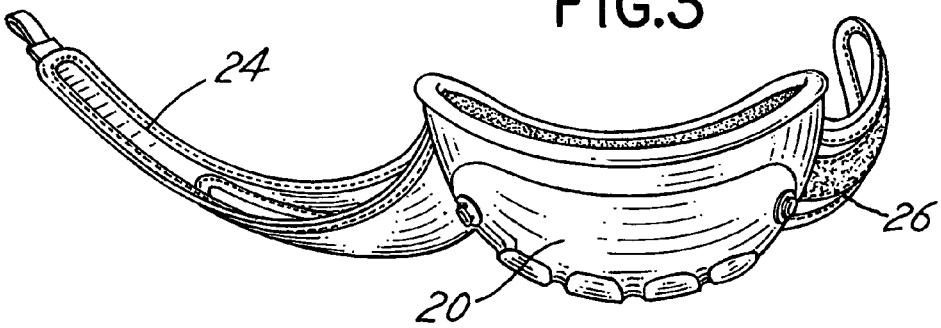

FIG.5
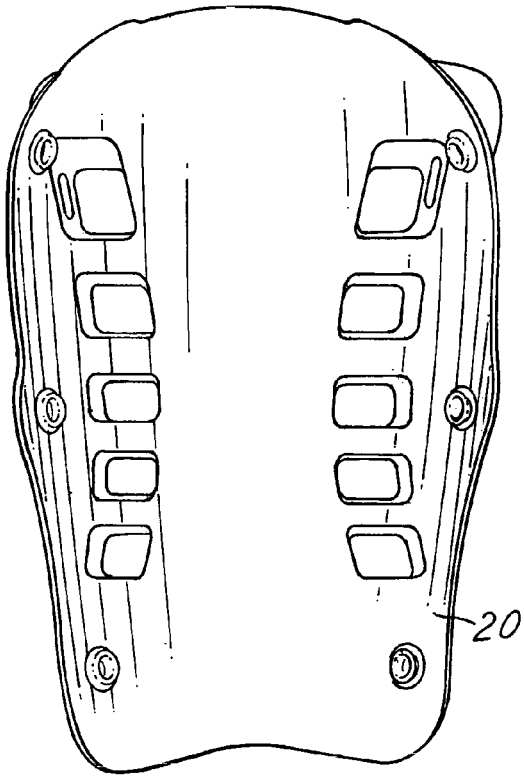
FIG.6
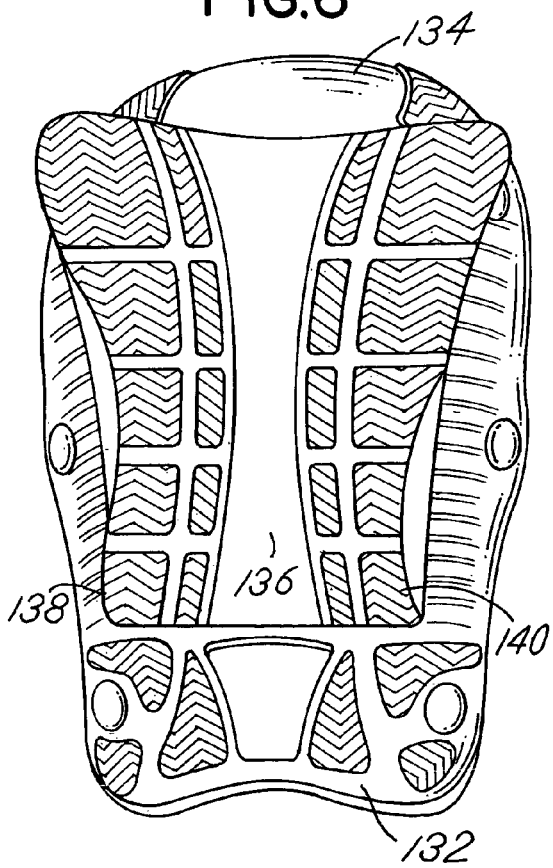
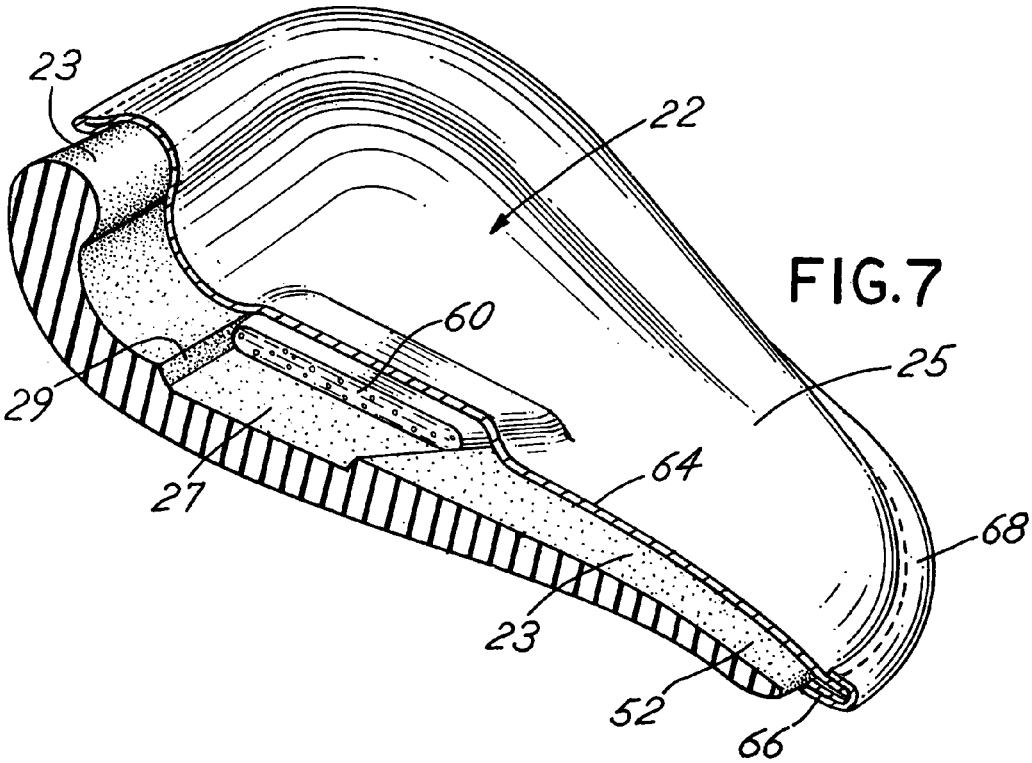
FIG.7

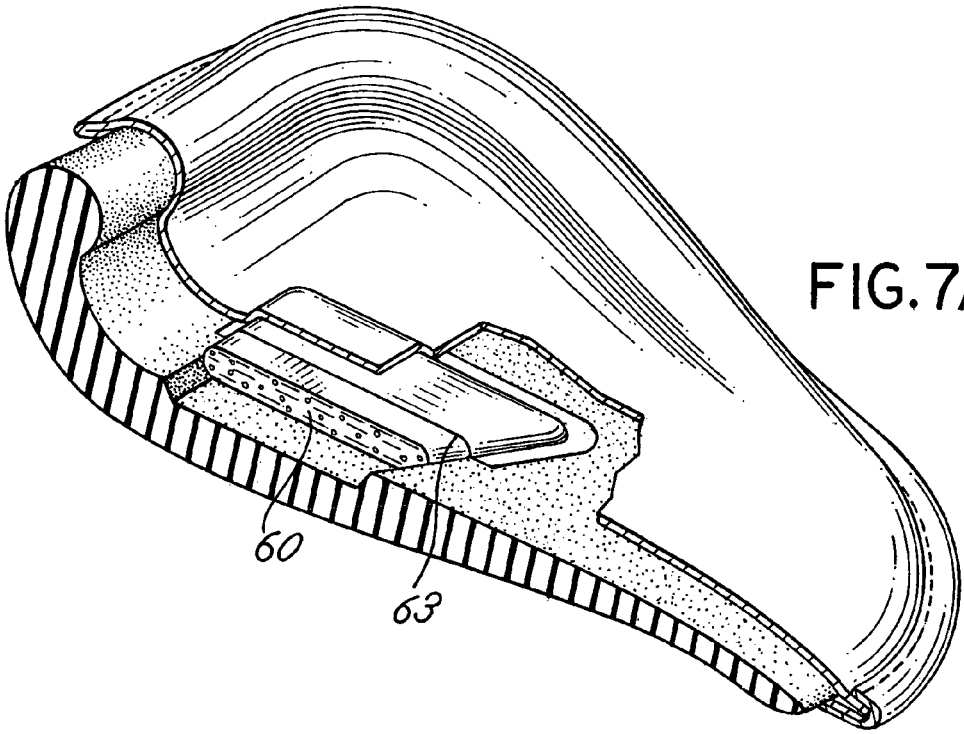
FIG. 7A
FIG. 8
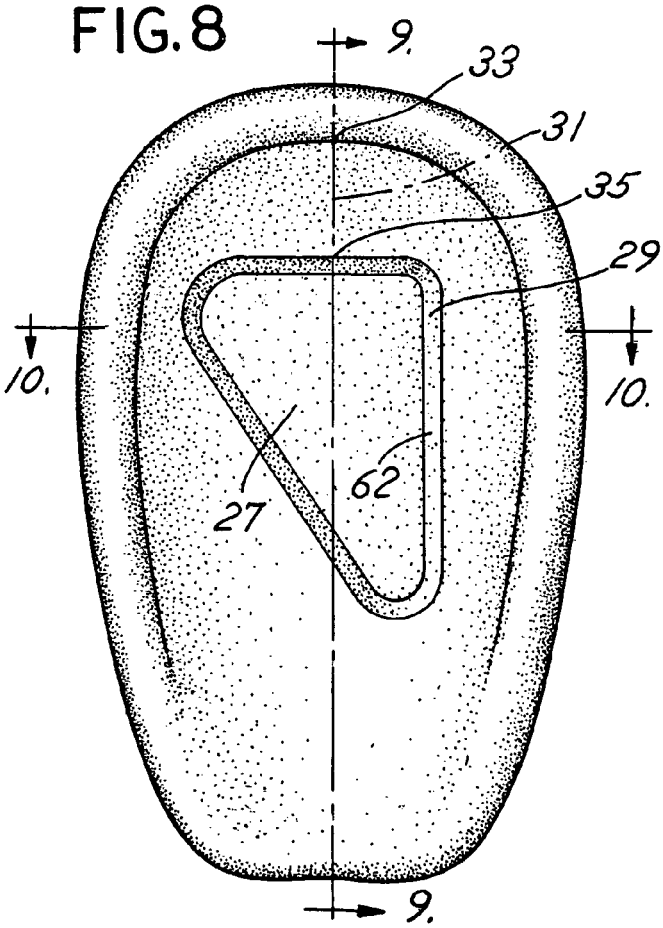
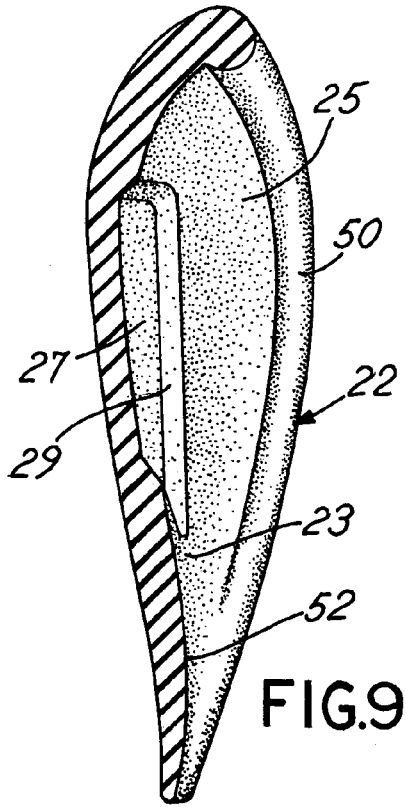
FIG. 9

KNEE PAD CONSTRUCTION

CROSS REFERENCE TO RELATED APPLICATION

This is a continuation in part application of Ser. No. 10/926,240 filed Aug. 25, 2004 now U.S. Pat. No. 7,181,770 entitled KNEE PAD CONSTRUCTION which is incorporated herewith by reference and for which priority is claimed.

BACKGROUND OF THE INVENTION

The present invention relates to a protective knee pad construction and, more particularly, to a pair of kneepads which are constructed to accommodate, respectively, the left knee and the right knee of an individual.

Protective knee pads are used by various individuals, for example, construction workers, mechanics, sportsmen, athletes, and others who find it necessary to protect their knees as a result of their work or activities. Utilization of protective knee pads placed on or around the knee for use when kneeling on hard surfaces is thus a common practice and, in some instances, a requirement in order to practice a trade or craft. Various knee pad constructions are available and typically comprise a rigid case or padding which is fitted over the knee and held thereon by attachment straps.

Knee pad constructions are the subject of various prior patents and applications including U.S. Pat. No. 6,584,616 B2 issued Jul. 1, 2003 and incorporated herewith by reference. Further knee pad constructions are disclosed in U.S. Pat. No. 6,223,350 for a Molded Kneepad Construction in U.S. Pat. No. 5,031,240 for a Kneepad; U.S. Pat. No. 5,794,261 for a Protective Joint Guard; U.S. Pat. No. 5,537,689 for a Protective Kneepad Having a Single Piece Cupping Means and Stitch Receiving Groove; U.S. Pat. No. 5,500,955 for a Kneepad for Athletes; U.S. Des. Pat. No. D473,977 for a Kneepad; and U.S. Patent Publication No. US2004/0111780 for a Kneepad.

Recently, there have been proposals for the construction of knee pads which account for the differentiation or distinction between the left knee of an individual and the right knee. Human anatomy exhibits differences between the shape of the left knee cap (or patella) and its position physiologically with respect to the skeletal structure and muscular arrangement and the right knee cap. The size, shape and configuration of knee caps may also vary from person to person. On the other hand, the general shape and location of the left knee cap and the right knee cap is similar, in many respects, from person to person.

Most knee pads, however, are universal in size and in shape and are considered interchangeable with respect to usage on the right and left knees of an individual. Such knee pads thus typically do not compensate for the distinction between left and right knees, or for the sizing of the knee of an individual. Consequently, there has remained a need for improved knee pad constructions.

SUMMARY OF THE INVENTION

Briefly, the present invention comprises a knee pad construction which includes a molded outer protective shell, casing or case affixed to or attachable to an interior pad assembly which has a generally convex outside surface and a generally concave inside shape into which the knee of an individual will fit. Typically, the interior pad assembly comprises a molded, flexible element or core in the form of a trough which is open at one end and closed at the opposite end and also which includes an interior cavity or recess sized and shaped for receipt of a flowable gel insert. In a preferred embodiment, a protective sheet of plastic material is fitted over or encapsulates the gel insert on the inside of the molded core. A further layer of fabric is then fitted over the plastic sheet and covers the inside face of the inside of the core element. The shape and size of the cavity or recess into which the gel insert is fitted relative to the shape and size of the gel insert itself is chosen to accommodate movement of the gel in a manner which permits the gel material to surround and cushion the knee of an individual placed against or on the gel insert. Also multiple gel inserts may be used. As an aspect of the invention, the cushion element, or core, which includes the shaped cavity and the recess, is provided with a peripheral lip to facilitate maintenance of the knee pad construction in position over the knee of an individual. The knee pad construction is designed to fit either the left knee or alternatively the right knee of an individual by providing a recess within the cushion element or core which is especially shaped to accommodate either the left knee or the right knee, as the case may be, and thus has a profile or shape which facilitates movement of the gel material in a manner that most effectively cushions the left or right patella or kneecap of an individual using the knee pads.

Thus, it is an object of the invention to provide an improved knee pad construction.

It is a further object of the invention to provide a knee pad construction which combines a concave elastic cushion member with a gel insert on the concave inside surface of the shaped elastic cushion member and layers of material to facilitate maintenance of the gel insert in a desired and appropriate position in the knee pad.

Another object of the invention is to provide a knee pad construction which will beneficially accommodate the left knee of an individual and a separate knee pad construction to accommodate the right knee of an individual.

Another object of the invention is to provide a knee pad construction which provides comfort to the user and which further includes means to insure appropriate positioning of the knee pad on the individual as well as maintenance of such a position on an individual.

A further object of the invention is to provide a knee pad having a rugged construction that is economical to manufacture, easy to use, lightweight and capable of use for a wide variety of knee sizes and shapes.

These and other objects, advantages and features of the invention will be set forth in the detailed description which follows.

BRIEF DESCRIPTION OF THE DRAWING

In the detailed description which follows reference will be made to the drawing comprised of the following Figures:

FIG. 1 is a backside, plan view of an embodiment of the knee pad of the invention for a left knee;

FIG. 2 is a front side, plan view of the knee pad construction of FIG. 1;

FIG. 3 is an end view of the knee pad construction of FIG. 1 viewed from the bottom side;

FIG. 5 is a plan view of the interior side of the outer case or casing of the assembly of FIG. 4;

FIG. 6 is a plan view of the outside of the case of FIG. 5;

FIG. 7 is a cut-away perspective or sectioned perspective view of the cushion element incorporated in the embodiment of FIG. 1;

FIG. 7A is a sectional, isometric view of the inside or concave interior of the pad assembly or core of one of the custom knee pads of the invention similar to FIG. 7 and illustrating the gel insert and plastic or polyethylene cover sheet for the gel insert;

FIG. 8 is a top plan view of the cushions of FIG. 7 for the right knee;

FIG. 9 is a sectional view taken along the line 9-9 in FIG. 8;

DESCRIPTION OF THE PREFERRED EMBODIMENTS

Figure 4:
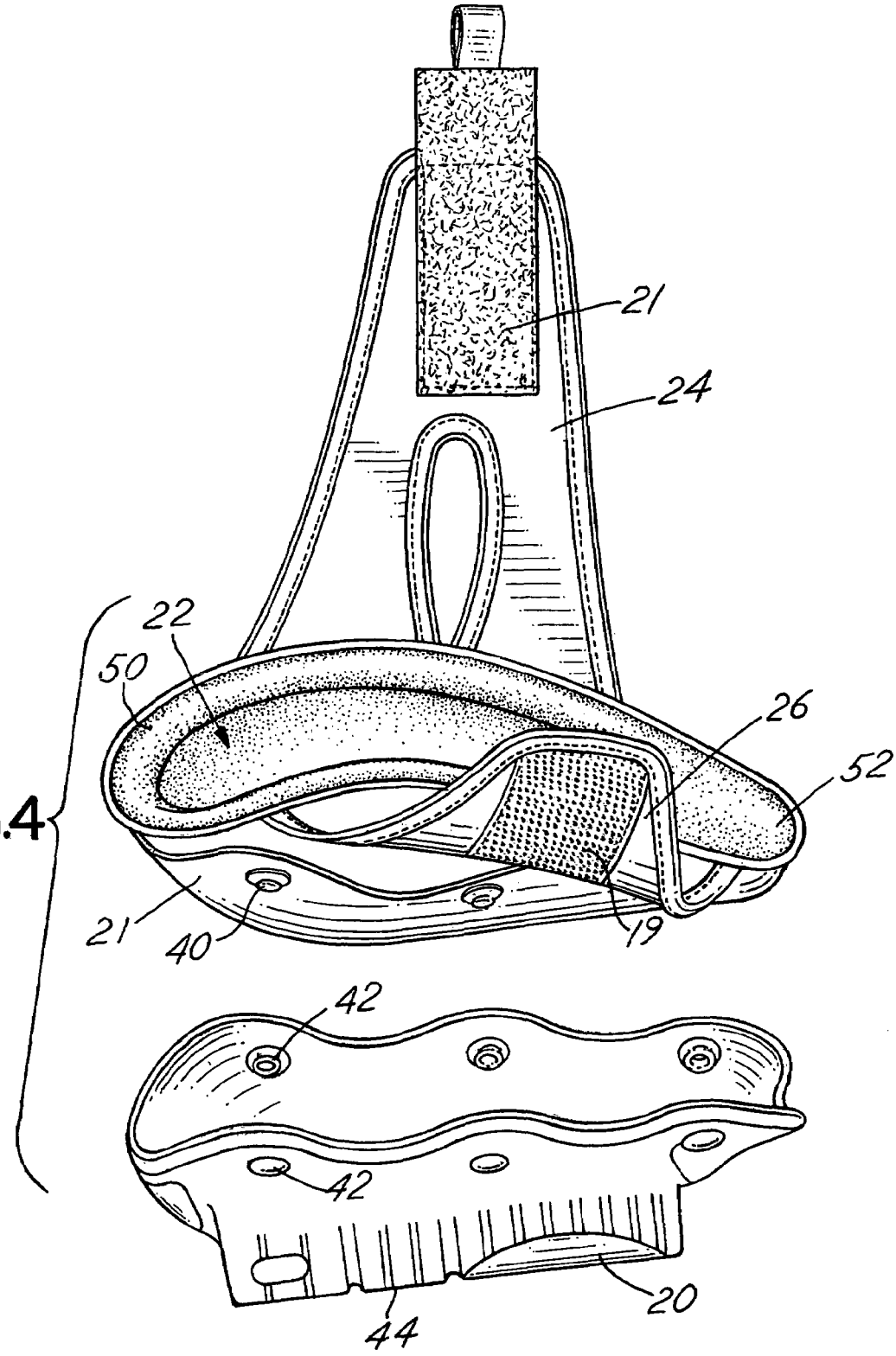
FIG. 4 is an exploded isometric view of the knee pad construction of the invention incorporating an outer, hard shell casing member and an interior cushion or core element or member or assembly.
Figure 10:
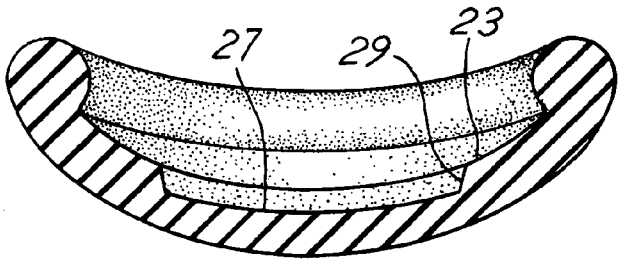
FIG. 10 is a sectional line taken along the line 10-10 in FIG. 8.
Figure 11:
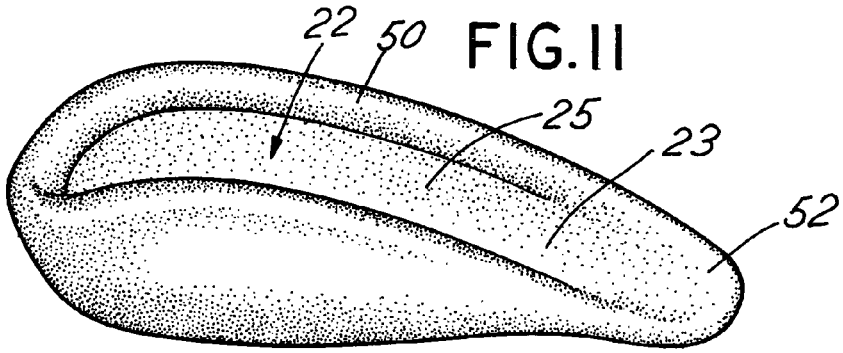
FIG. 11 is a side view in partial perspective or isometric of the cushion element of FIG. 9.
Figure 12:
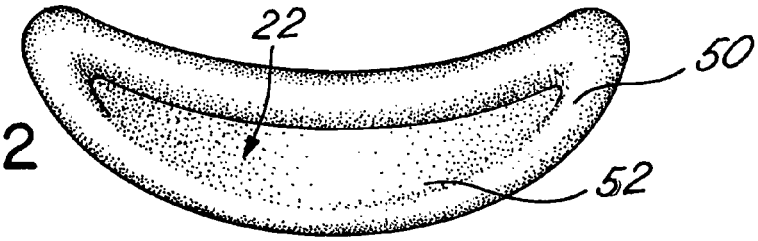
FIG. 12 is a back or bottom end view or right hand end view of the cushion element of FIG. 11.
Figure 13:
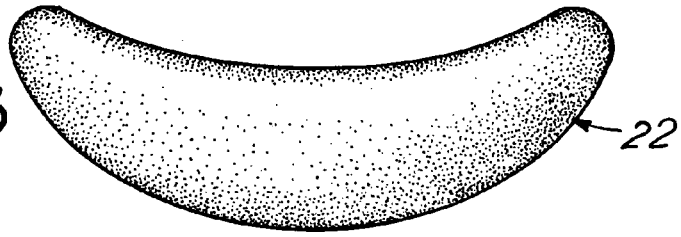
FIG. 13 is a front view or left hand end view of the cushion element of FIG. 11.
Figure 14:
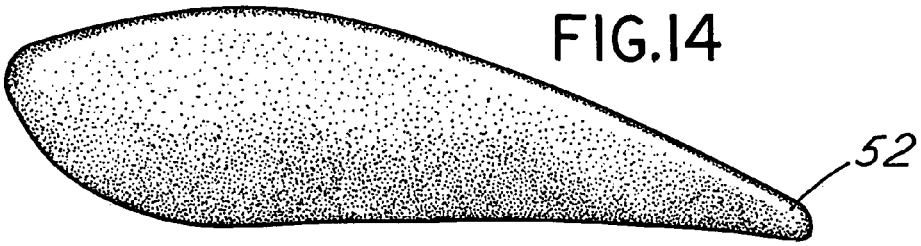
FIG. 14 is a side view of the cushion element of FIGS. 9-13.
Figure 15:
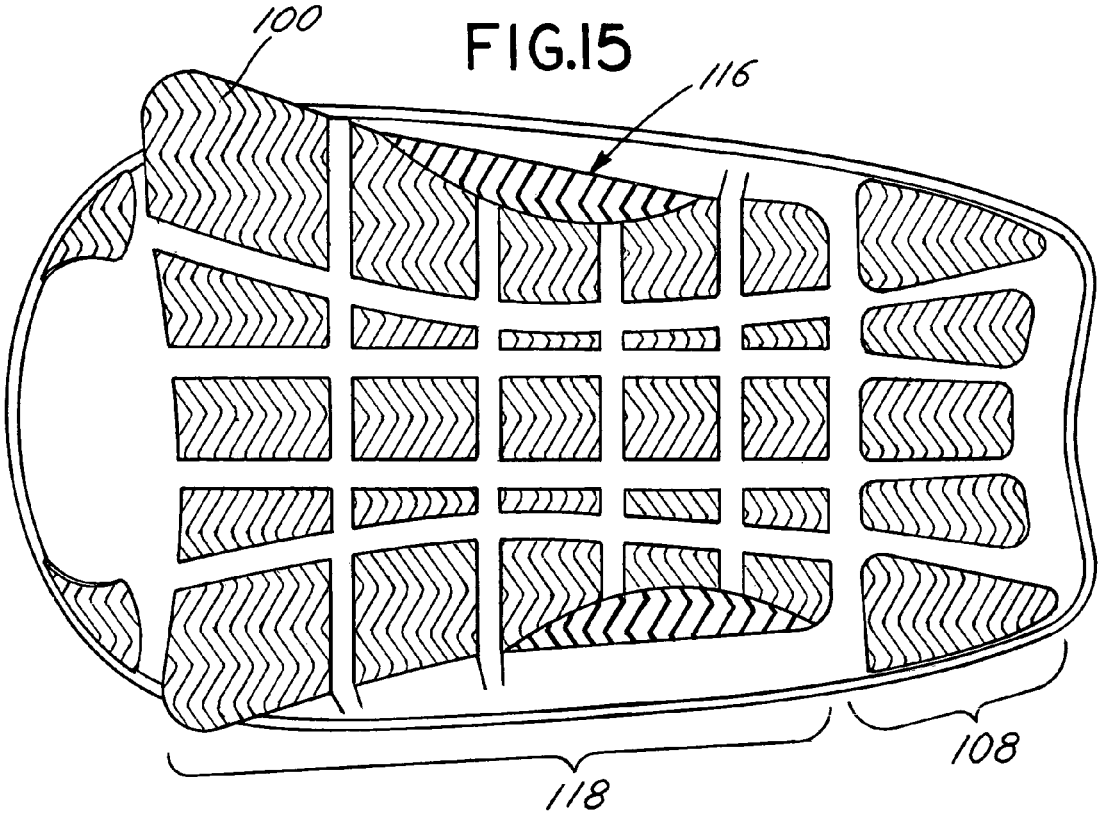
FIG. 15 is a plan view of the outside face of the casing or shell utilized in combination with the pad assembly as illustrated, by way of example, in FIGS. 7 or 7A.
Figure 16:
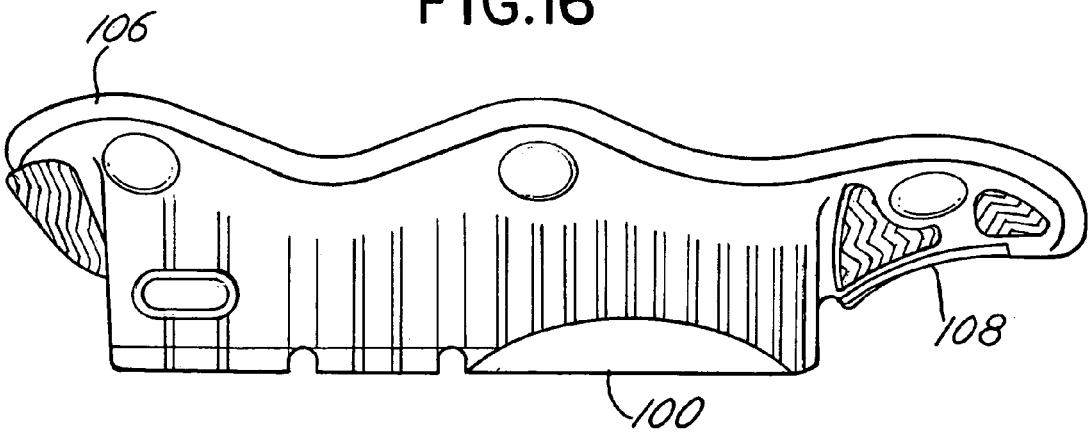
FIG. 16 is a side elevation of the casing of FIG. 15.
Figure 17:
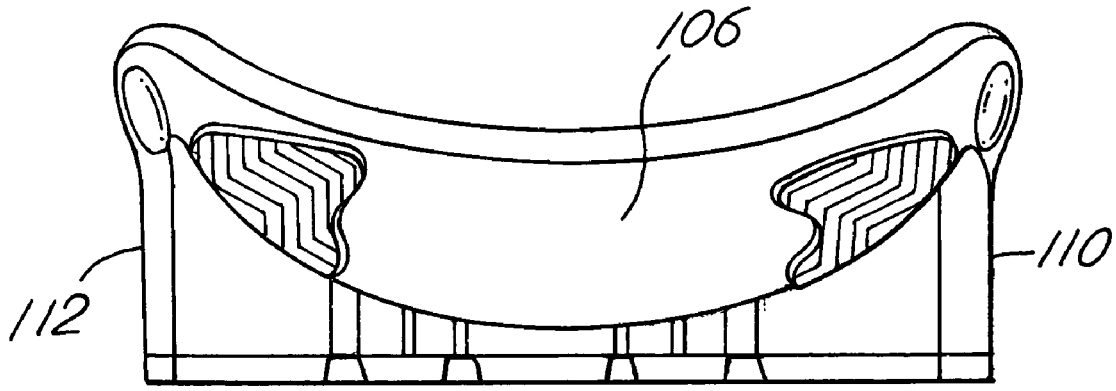
FIG. 17 is a bottom or right-hand end view of the casing of FIG. 15.
Figure 18:
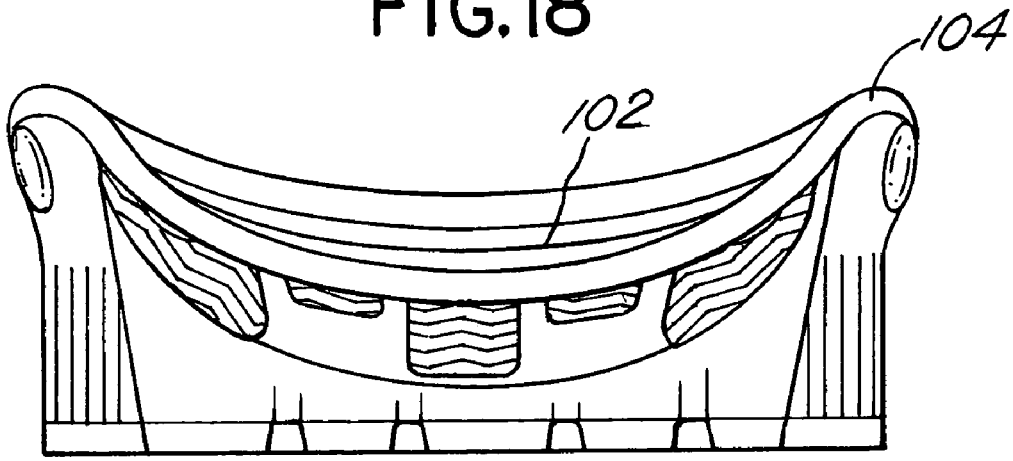
FIG. 18 is a top or left-hand end view of the casing of FIG. 15.

Referring to the figures, and in particular FIG. 4, a preferred embodiment of a knee pad assembly of the invention is generally comprised of two basic components. The first component is an outer shell or casing or case 20. The second basic component is an inner, shaped cushion element, pad assembly or core 22 (See FIGS. 1-3) which includes a strap construction, for example, strap 24 and compatible strap attachment 26. The casing or shell or case 20 is affixed to the shaped cushion element 22 to provide a hard outer layer or shell which is designed to engage against a surface, such as a floor. The hard outer casing or shell 20 is typically attached by means of snaps, for example, snaps 30, 32, 34 and 36 to the interior shaped cushion element 22. That is, an external convex surface 21 of the cushion element 22 includes snap members 40 compatible with snap members such as snap member 42 of shell 20, for attachment of the shell or casing or outer member 20 to the cushion element 22. In this manner, the outer casing or shell 20 may be manufactured from any of a number of materials including a hard rubber material, a rigid plastic material, or other materials. Further, the shell or case 20 may be manufactured in any of a number of configurations or shapes. Thus, the outside face or surface 44 of such a case or shell 20 may be configured in a manner which will provide appropriate support for a person utilizing the knee pad construction to facilitate their balance and movement. Further, the hard shell or case 20 may be replaced by various other types of outer elements or casing materials or entirely omitted in certain circumstances. And the shell 20 may be replaced when damaged or when a different configuration is desired. In certain circumstances, the shell 20 may be eliminated.

The inner shaped core or cushion element 22 is in the form of a trough having a concave interior defined by an internal face surface 23 with an upstanding side 25 extending about three quarters of the circumference of the surface 23. The trough shape thus has a generally closed top or front end and a generally open bottom or lower end 52. A peripheral top rib 50 extends approximately about the periphery of the trough 22 except for the lower end or bottom end 52. That is, as shown in FIG. 7, the cushion element 22 is in the form of a trough having a partially circumferential rib 50 and an open lower end or extremity 52. The open ended trough construction enables placement of the rib 50 against the leg of a person along the region above the knee and on the sides of the knee. The lower end 52 of the trough 22 is open and thus fits against the shin without causing discomfort. The rib 50 has a thickness greater than the side or side walls 50.

The core 22 is made from a generally elastic material such as a closed cell rubber or elastomeric. The core 22 is thus molded and in its molded configuration will maintain the shape, but be appropriately elastic so that it will flex and facilitate cushioning of the knee and leg. The rib 50 which fits around the periphery of the core 22, facilitates retention of the core 22 tightly in position and oriented properly on the knee and leg of an individual using the knee pad construction. Rib 50 thus follows the contour of the knee and leg to which the core 22 is attached.

The internal face surface 23 of the core 22 further includes a central depression or recess 27. The recess 27 is positioned in alignment with the position of a patella which would fit into the core 22. As shown in FIG. 9 the recess 27 has a generally polygonal configuration, although other configurations are deemed useful. The recess 27 includes a peripheral, receding wall 29 extending into the interior of the recess 27 from surface 23. In the embodiment shown in FIG. 8, the recess 27 is designed for the right hand knee and is generally triangular in shape with the volume of the recess 27 defined on the right hand side of a vertical center line 31 being greater than the volume defined or within the recess 27 on the left hand side of the center line 31 generally midway between the lateral sides of rib 50. Further, the upper end boundary 35 of recess 27 is positioned along the axial length of the vertical center line 31 generally in the range of at least about one half inch to about 3 ½ inches from an inner boundary 33 of the rib 50. The axial length of recess 27 is in the range of about 1 ½ to 3 ¾ inches and the maximum width is about 1 to about 3 inches.

In a preferred embodiment, a flowable gel material 60 is inserted into the recess 27. The flowable gel material 60 has a thickness substantially equal to the depth of the recess 27 which is about ¼ to ½ inch and a configuration generally congruent with the lower, interior boundary 62 of the recess 27. Preferably, a sheet of plastic material, such as a thin sheet of polyethylene or polypropylene, fits over the insert 60, is affixed to surface 23, and facilitates retention of the insert 60 within the recess 27. A sheet membrane 64 is then placed over the interior of the trough 22 as depicted in FIGS. 7 and 7A. Preferably, a companion membrane 66 is fitted over the outside of the trough 22 and a binding 68 is sewn thereto in order to maintain the membranes 64 and 66. The membranes 64 and 66 may be a fabric material by way of example.

Flexible attachment straps 24, 26 of a desired configuration may also be attached by sewing, for example, to the outer membrane 66. For example, the straps 24 and 26 may be attached to the outer membrane 66 so that the knee pad construction may be affixed snugly over the knee of an individual and held by straps 24, 26 connected in the back side of a knee. As shown in FIG. 1, the strap 24 includes a hook and loop fastener 21 which cooperates with a hook and loop fastener 19 to facilitate maintaining the knee pad on an individual. The strap 24 is preferably split or bifurcated where attached to the membrane or cover 66. This prevents uncomfortable traveling of the strap 24. Also, the end of each long strap 24 extends behind the knee and fastens on the outside of the knee for each knee pad. The straps 24 thus enable a worker to associate the position of the long strap 24 with the right or left knee as the case may be knowing that the long end strap 24 fits around the back of a knee and attaches on the outside.

FIG. 8 illustrates the configuration of the interior of a trough 22 and recess 27 for the right knee of an individual. FIG. 1 illustrates the configuration for the left hand knee of an individual. It is to be noted that the recess 27A for the left hand knee is the mirror image, in the preferred embodiment, of the recess 27 for the right hand knee as depicted in FIG. 8. In the preferred embodiment, the separate recesses 27 and 27A, as well as their companion insert gel 60, 60A are mirror images of one another to accommodate the left and right patella of an individual. However, the invention is not limited to a construction wherein the respective recesses 27 and 27A, as well as the inserts 60 associated therewith are mirror images of one another. Each may be custom designed for achieving appropriate positioning and balance in combination with the use thereof as a knee pad. Typically, the design of the troughs 22 (except for recesses 27, 27A) will be generally the same. However, trough 22 may also be customized for the right and left knees.

An important feature of the invention is the peripheral rib 50 which facilitates positioning of the knee pad construction on an individual. The peripheral rib 50, in combination with the position of the gel insert 60 insures that the knee of an individual or the patella will be appropriately oriented within the knee pad construction for the left and the right knee. The spacing or position of the rib 50 forwardly and upwardly relative to the gel insert 60 thus becomes a feature of the invention. Further, the rib 50 is generally molded to the elastic trough 22 and provides lateral or side support for positioning the knee relative to the insert 60 within the recess 27. Thus, the trough 22 is made from a material which is flexible or slightly elastic so that it can effectively grip onto the sides of a knee of an individual.

The shell on case 20 is depicted in further detail in FIGS. 15-18. shell 20 includes a generally flat, planar outside face 100, with an inside trough 102 generally compatible with or congruent with the outside face of the pad assembly or case 22. Shell thus includes a peripheral side wall 104 with a front end 106 and a lower end trough section 108 to fit over the upper shin of a person. Outside lateral right and left walls 110, 112 of case 20 are spaced from one another in the range of 3 to 5 inches adjacent the front end 106 to enhance stability and spread the pressure on the pad at the tope end 106. The medial section 116 is narrower and inclined to facilitate manufacturability. The elongate or axial dimension 118 in FIG. 15 of the flat planar section 100 is generally in the range of 5 to 9 inches to enable tilting or incline of the knee pad while providing an enlarged arc of support. The lower end trough section 108 is recessed relative to planar surface 100 again to facilitate maneuverability of the knee pad assembly. The outside face or surface 100 is segmented and ribbed in the preferred embodiment to insure proper gripping action.

FIG. 6 illustrates an alternate embodiment of a shell 20. In FIG. 6, the shell 20 includes a planar outside face 130 with a lower end 132, an upper end 134 and a configuration size and shape generally like the embodiment of FIG. 15. However the outside face 130 includes an elongate center recessed portion 136 positioned intermediate flat, coplanar lateral side portions 138, 140.

Figure 19:
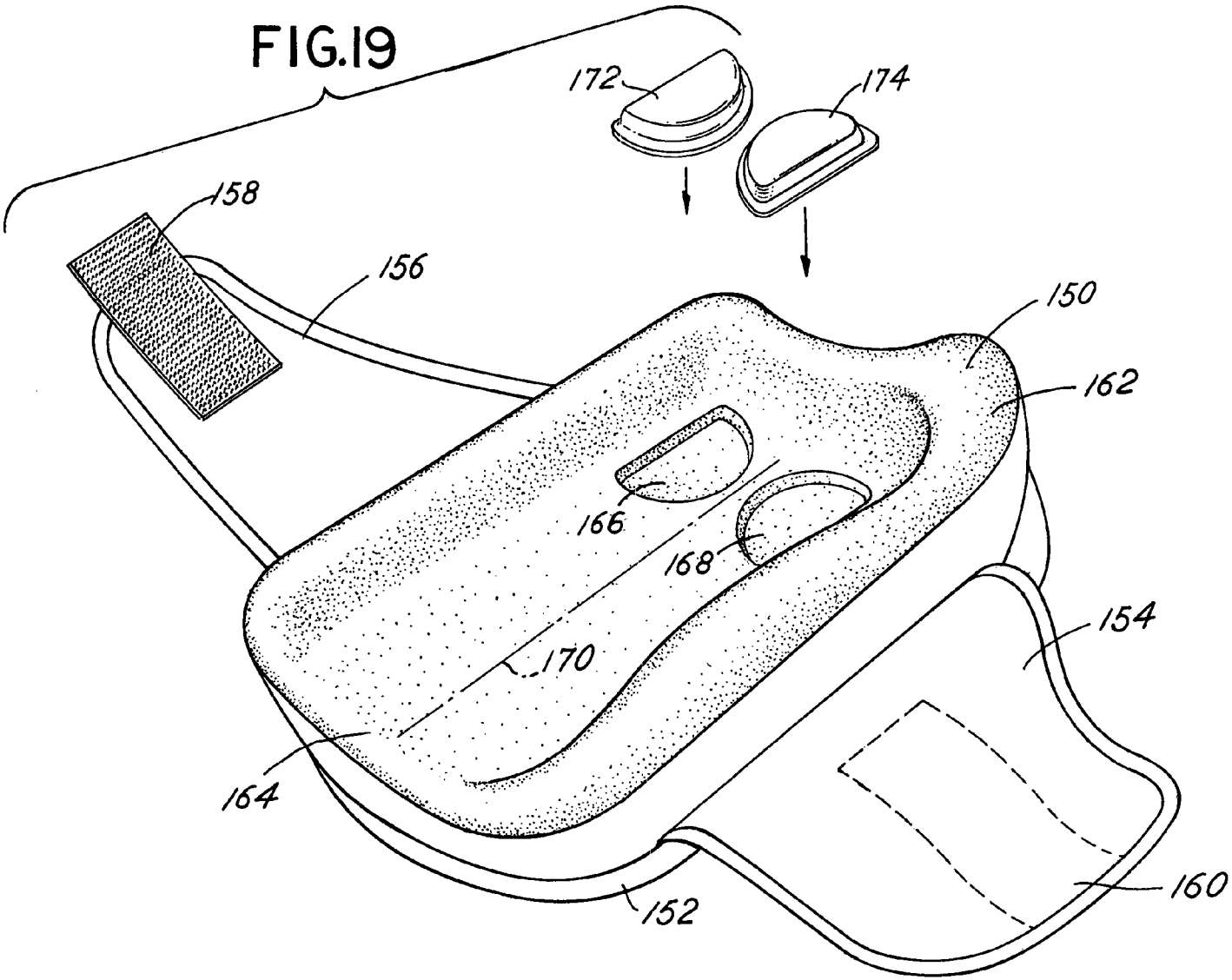
FIG. 19 is a partially exploded, isometric view of the inside of an alternative embodiment of the invention utilizing multiple gel inserts in each knee pad.
Figure 20:
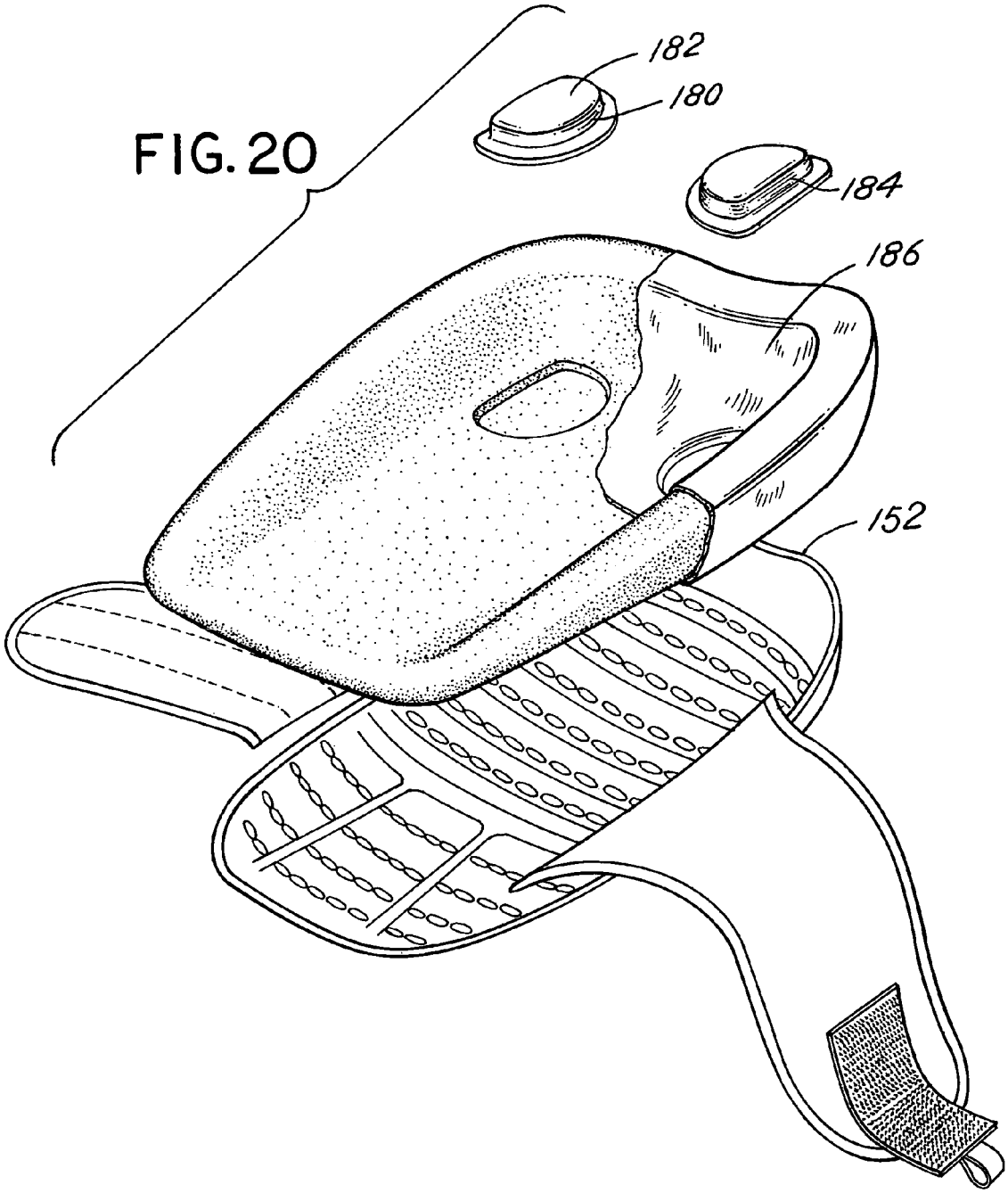
FIG. 20 is a full exploded isometric view of the embodiment of FIG. 19.
Figure 21:
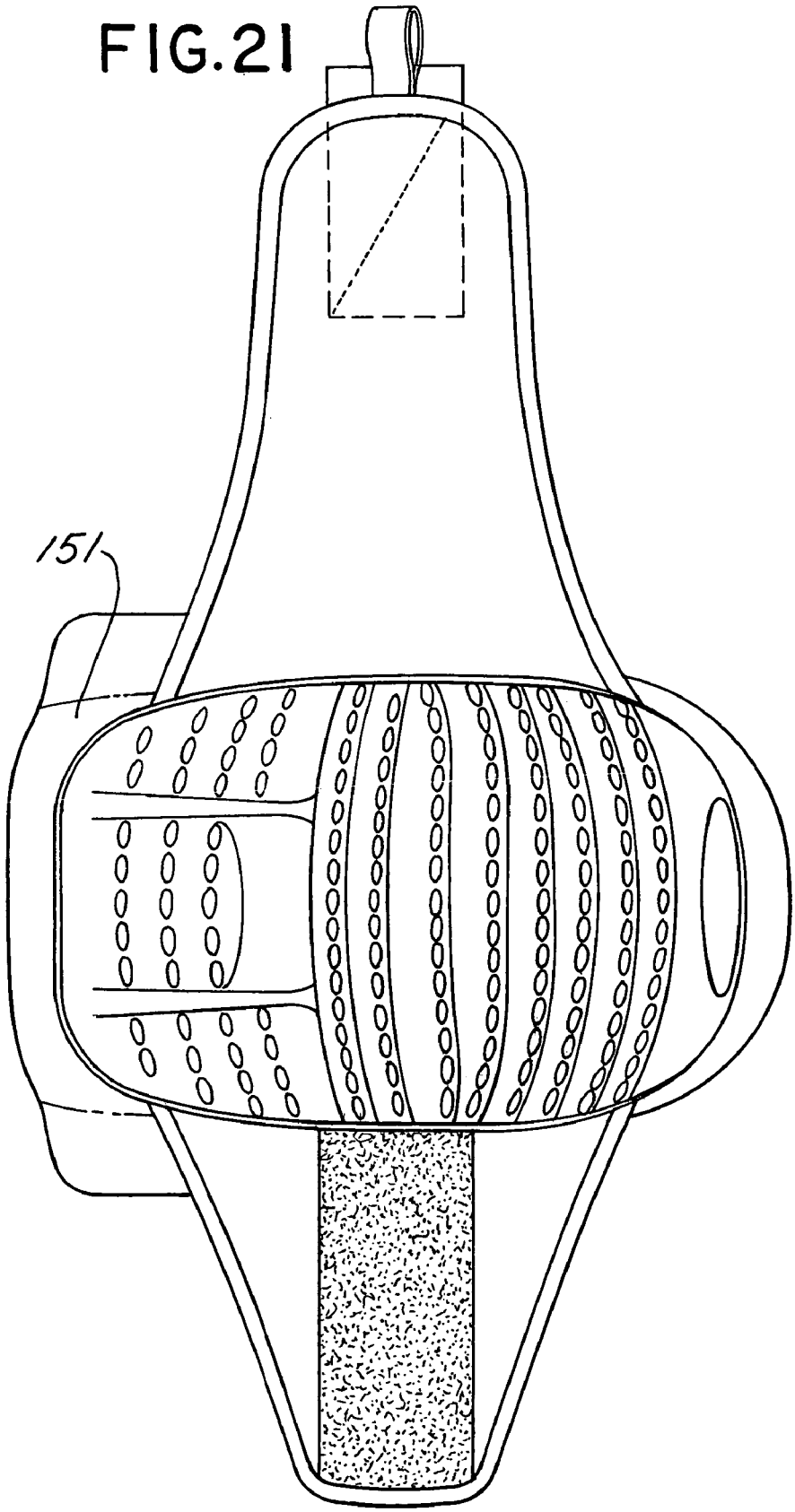
FIG. 21 is a plan view of the outside face of the knee pad of FIG. 19.

Referring to FIGS. 19-21 there are depicted alternative embodiments of the invention. In one alternative embodiment, the core or trough 150 includes a hard outer shell or casing 152 affixed thereto and further includes lateral side straps such as short side strap 154 and longer side strap 156. The side straps 154, 156 as described previously are designed to fit about the back side of a knee and join on the outside of the knee when the knee pad is attached. Thus, in the embodiment of FIG. 19 the long strap 156 fits about the back side of the right knee of an individual and joins with the shorter strap 154 on the outside, right-hand side of the knee. The straps 154, 156 are attached together or joined together by means of a hook and loop fastener, for example, a hook and loop fastener element 158 on strap 156 joins or attaches to a hood and loop fastener element 160 on strap 154.

The core 150 includes a generally peripheral rib 162 and comprises an open ended trough with a lower end 164 designed to comfortably fit over the shin of an individual. The core 150 further defines a concave interior trough having a first recess pocket 166 and a second, non-overlapping or adjacent recess pocket 168. Pockets 166, 168 are spaced laterally on opposite sides of a generally elongate center line axis 170. The recesses or pocket 166 and 168 are for receipt of gel insert packets 172 and 174 respectably. These insert packets 172, 174 are packets of flowable gel encapsulated in plastic film such as polyethylene film. The inserts 172 and 174, which are compatible with and thus fit into the recess pockets 166 and 168 respectively are aligned or positioned in a manner which enables them to cushion a patella or kneecap which is positioned between them generally along the centerline axis 170. In a preferred embodiment, each of the inserts 172 and 174 are generally symmetrical mirror images of one another. In the embodiment shown these inserts include a rounded interior side 180, a generally planer top side 182 and a generally planar exterior or outside 184. The inserts 172, 174 and more particularly the gel material within the inserts 172, 174 flows in response to pressure applied thereto by positioning the patella or kneecap thereon. Thus, the core element 150 becomes customized for size, shape and location of a knee positioned therein. As with the prior construction described the core or core element 150 typically includes a fabric covering 186 over the concave interior surface inserts 172, 174.

The outside surface 151 of the core element 150 is generally convex and is designed to receive a hard shell 152 as previously described. The hard shell 152 may, for example, be a molded plastic material which fits over and is compatible with the outside surface 151 of the core element 150. The various elements described may be sewn together. That is the hard outer shell 152 may be stitched to the straps 154 and 156 and those elements in turn stitched in the same operation to fabric which encapsulates the core element 150.

Its possible to vary the size, position and shape of the opposed inserts 172 and 174. A preferred embodiment of the inserts 172, 174 is depicted wherein those inserts 172, 174 are comprised of pairs of mirror image symmetrically positioned inserts 172, 174. However, the inserts 172, 174 may each be uniquely configured. Additionally, multiple inserts may be included to provide for an additional cushioning effect. The depth of the recesses in which the inserts are positioned and the depth of the inserts may be varied. Numerous variations of the construction are thus possible.

While there has been set forth a preferred embodiment of the invention, it is to be understood that the invention is to be limited only by the following claims and equivalents thereof.

What is claimed is:

1. A knee pad comprising:

a shaped cushion element having a concave interior in the form of a trough with a forward, upper wall, a first lateral side wall for positioning against the outside of a knee, a second lateral side wall for positioning against the inside of a knee, an inside surface, and an open lower end, said inside surface including at least two separate, non-overlapping gel receiving recesses spaced from each other on said inside surface with a peripheral recess side wall in each said recess; and a gel insert positioned in each said recess, each said gel insert having a configuration substantially congruent with the configuration of the recess in which it is positioned, each said gel insert deformable in response to placement of a knee of an individual against each said insert to displace portions of each said insert toward the peripheral recess side wall of the recess in which said insert is positioned to accommodate positioning of a knee against the inserts.

2. The knee pad of claim 1 further including a flexible, elastic sheet positioned over the said gel inserts.

3. The knee pad of claim 1 wherein said cushion element includes at least a partial peripheral rib around upper wall and lateral side walls having a thickness greater, at least in part, than the adjacent portion of the said wall of the cushion element to define a deformable, elastic lip.

4. The knee pad of claim 1 further including an outside shell element attachable to the cushion element.

5. A set of two knee pads in accord with claim 1, said pads configured respectively for the left knee and right knee.

6. A knee pad comprising:

a shaped cushion element having a concave interior in the form of a trough with a forward, upper wall, a first lateral side wall for positioning against the outside of a knee, a second lateral side wall for positioning against the inside of a knee, an inside surface, and an open lower end, said inside surface including at least two separate, non-overlapping gel receiving recesses with a peripheral recess side wall in each said recess, a gel insert positioned in each said recess, each said gel insert having a configuration substantially congruent with the configuration of the recess in which it is positioned, each said gel insert deformable in response to placement of a knee of an individual against the said insert to displace portions of each said insert toward the peripheral recess side wall of the recess in which said insert is positioned to accommodate positioning of a knee against the inserts; and further including a flexible elastic sheet positioned over at least one of said gel inserts.

* * * * *